United States Patent [19]

Keromnes et al.

[11] Patent Number: 5,033,065

[45] Date of Patent: Jul. 16, 1991

[54] APPARATUS FOR COUNTING CONVEYED OBJECTS

[75] Inventors: Bernard Keromnes, Morlaix; Jean-Pierre Breuil, Taule, both of France

[73] Assignee: Breuil, S.A., Landivisiau, France

[21] Appl. No.: 415,308

[22] PCT Filed: Jan. 19, 1989

[86] PCT No.: PCT/FR89/00016

§ 371 Date: Sep. 19, 1989

§ 102(e) Date: Sep. 19, 1989

[87] PCT Pub. No.: WO89/06842

PCT Pub. Date: Jul. 27, 1989

[30] Foreign Application Priority Data

Jan. 19, 1988 [FR] France ..... 88/00535

[51] Int. Cl.[5] ..... G06M 7/00; B07C 5/10; G01N 21/00

[52] U.S. Cl. ..... 377/6; 250/221; 250/227.11; 377/53

[58] Field of Search ..... 377/6, 53; 250/221, 250/227.11

[56] References Cited

U.S. PATENT DOCUMENTS

| | | | |
|---|---|---|---|
| 4,343,991 | 8/1982 | Fujiwara et al. | 250/227.11 |
| 4,628,520 | 12/1986 | Menger | 377/6 |
| 4,635,215 | 1/1987 | Friend | 377/6 |
| 4,782,500 | 11/1988 | Lyngsie | 377/6 |
| 4,868,901 | 9/1989 | Kniskern et al. | 377/6 |

FOREIGN PATENT DOCUMENTS

| | | |
|---|---|---|
| 3603927 | 8/1987 | Fed. Rep. of Germany . |
| 2528972 | 12/1983 | France . |
| 61-98490 | 5/1986 | Japan . |

*Primary Examiner*—John S. Heyman

*Attorney, Agent, or Firm*—Sandler, Greenblum & Bernstein

[57] ABSTRACT

The invention relates to an apparatus for counting objects, which includes a light emitting system intended to form an emission zone, a light receiving system forming a plurality of substantially aligned reception points, a passage between the emission zone and the reception points to allow the conveying of objects to be counted substantially perpendicularly to the alignment of reception points, and a counting system provided to determine the number of conveyed objects as a function of the variations of light received at the reception points, which variations are due to the interpositioning of objects between the emission zone and the reception points. The receiver system includes a plurality of receivers intended to each form a reception point, while the emitter system includes as many individual emitters are there are receivers, and forms a plurality of substantially aligned emission points; the emitters being provided to each emit a directive light beam and the receivers being associated by pairs with the emitters so that each receiver is provided to collect to receive, in the absence of an object, the light beam from the emitter with which it is associated and a consequently generate a signal.

11 Claims, 3 Drawing Sheets

F a1 a2 a17 a 18

1
2
3
4
5
6
7
8
9
10
11
12
13
14
15
16
17
18

T

ET5

V5
0--1,2,3,---10, ----24, ---
---52 0-----

Pl
22
44
66

N

APPARATUS FOR COUNTING CONVEYED OBJECTS

BACKGROUND OF THE INVENTION

1) Field of the Invention

The invention relates to an apparatus for counting objects which are conveyed in said apparatus, the objects which may be for example, quick-frozen goods. The invention is however more particularly adapted to count small animals such as chicks, ducklings, young turkeys, young guinea fowl, etc.

2) Description of Background and Other Information

In an automated packing line, it is known to count the goods at the end of the line to place them by group in containers such as boxes.

The problem becomes obviously difficult when it involves counting loose goods whose shapes are not truly defined or different depending on the position that they can take, like quick-frozen croissants, for example.

Finally, it is clear that the difficulties are further increased when it involves counting living animals, which can of course move and be presented by groups or by unit, as in an incubator equipment line, for example.

A known counting apparatus includes a light emitting system adapted to form an emission zone, a light receiver system forming several reception points, which are substantially aligned, a passage between the emission zone and the reception points, to permit the conveying of objects to be counted in a manner substantially perpendicular to the alignment of the reception points, and a counting system, which is provided to determine the number of objects conveyed with respect to the variations of the light received at the reception points. These variations are due to the interposition of objects between the emission zone and the reception points.

SUMMARY OF THE INVENTION

However, known systems are not generally satisfactory, particularly because of the disturbances caused by the exterior environment on the light emitted for measuring. This is why the invention proposes an apparatus of the type mentioned above but which is remarkable in that the receiver system comprise a plurality of receivers, each adapted to form a reception point, whereas the emitting system comprises as many individual emitters as there are receivers and form several emission points, substantially aligned. The emitters each emit a directional luminous beam and the receivers are associated by pairs with said emitters, such that each receiver is provided to catch, in the absence of the object, the luminous beam of the emitter with which it is associated and to consequently create a signal.

Preferably, each emitter-receiver pair is presented in the form of a single unit connected by optic fibers, on the one hand to an emission point and, on the other hand, to a reception point.

To best avoid further exterior disturbances and interferences from one beam to the other, each emitter is preferably provided to emit a luminous beam of modulated infrared light.

An embodiment according to the invention comprises a system for transformation of the signals coming from the receivers, to transform them into impulses for counting objects. The signal transformation system is preferably provided with a cyclical scanning means which is provided to periodically transform each signal into a deduction impulse when said signal is in a certain state.

In this case, for example, a counter is provided to count the number of deduction impulses which are emitted at each scanning cycle, while a comparator is provided to compare the number of deduction impulses at certain predetermined values and to emit a counting impulse each time the number of deduction impulses reaches one of the predetermined values.

Each receiver can also be connected to one of the inputs of a logic gate, which itself is connected to the counter of deduction impulses, so as to deliver an output signal, which frees said counter as soon as said signal shows a state for which at least one of the luminous beams is interrupted.

The logic gate can also be likewise connected to a comparison clock which is adapted to deliver an alarm signal when the gate signal remains in the state corresponding to the interruption of at least one of the beams, during a time period which becomes greater than a predetermined time period.

According to one embodiment, the comparator is provided to generate an signal of alarm or error when the number of counting impulses becomes greater than a predetermined value. Thus, it is possible to consider the signal as an error signal when the number of impulses, and thus the number of objects counted, becomes too great and there is a risk of counting error.

BRIEF DESCRIPTION OF THE DRAWINGS

The invention will be better understood by referring to the description which follows and which refers to the annexed drawings in which.

DETAILED DESCRIPTION OF THE PREFERRED EMBODIMENT

Figure 1:
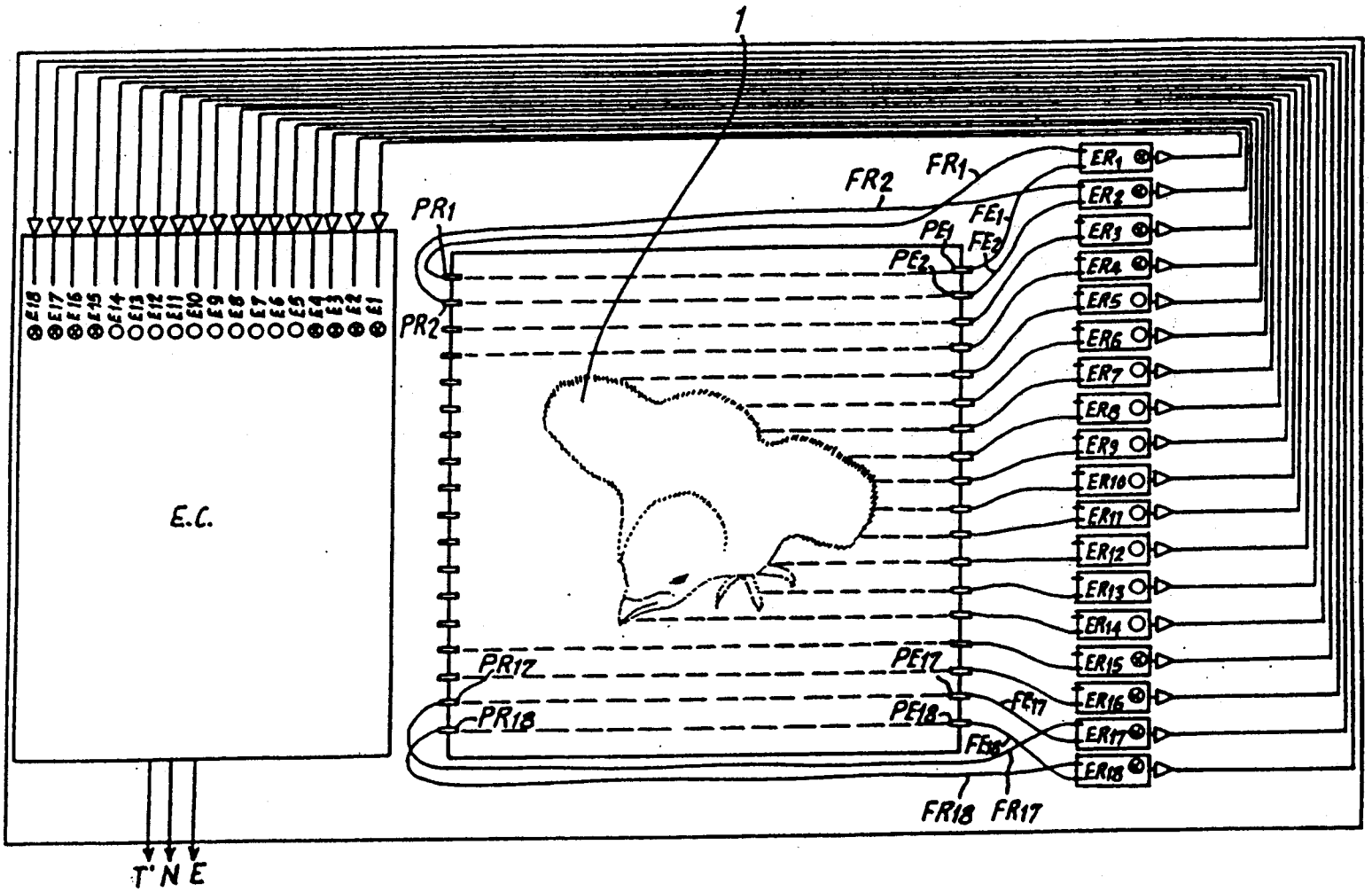
FIG. 1 shows schematically one part of an apparatus according to the invention, FIG. 2 schematically shows an electronic management card

In FIG. 1 one can see a series of emitter-receivers, eighteen in the example shown, which are referenced ER1–ER18.

The emitter-receivers ERi are positioned vertically under one another (as shown in FIG. 1) and are each connected to an emission point and a reception point such as PE1, PR1; PE2, PR2; PE17, PR17 and PE18, PR18.

Each emission or reception point is connected to the corresponding emitter-receiver by an optic fiber such as FE1,FR1; FE2, FR2; FE17,FR17; FE18,FR18.

For more clarity, only certain emission and reception points and only certain optic fibers are illustrated, and a large number are also eliminated from the drawing. However, it is obvious that each emitter-receiver ERi is connected by optic fibers, on the one hand to an emission point PEi and on the other hand, to a reception point PRi.

In addition, all the emission points PEi are positioned vertically above one another, in the same manner as the reception points PRi.

Between the emission points PEi and reception points PRi is provided a passage for the conveying of objects to be counted such as the chick schematically shown in FIG. 1. The conveying (by moving belt or other conveyer) of the objects, occurs perpendicularly to the alignment of points PEi and PRi, i.e. in the example, perpendicularly to the plane of the drawing. However, it must be understood that if the points PEi and PRi are positioned here vertically, it is not impossible to for them to be arranged horizontally (drawing viewed in the sense of a plane view), the conveying being still in the previously indicated direction. The vertical position shown, was selected to avoid certain risks of stains at points PEi and PRi due to the objects to be counted themselves.

Each emitter-receiver ERi is constituted by a photoelectric cell, adapted to gencrate a beam of infrared light at its corresponding emission point PEi and to create a signal after having obtained said beam at its reception point PRi when no obstacle is interposed between the two previously cited points, i.e., the object does not cut the beam. As FIG. 1 shows, the chick 1 cuts the beams of the emitter-receivers ER5–ER14. This is to particularly avoid the incidence of the surrounding light that the inventor recommends for the infrared light. Moreover, to avoid interference between beams, the beams are the finest possible and are preferably constituted by a modulated light (a wave length for each emitter). Of course, apparatus is provided to demodulate each beam of light received.

All the emitter-receivers are connected, as FIG. 1 shows, to an electronic card EC, which is furnished with as many inputs E1–E18 as there are emitter-receivers ER1–ER18.

The card EC delivers three signals T', N and E. This card EC is shown in more detail in FIG. 2.

Figure 2:
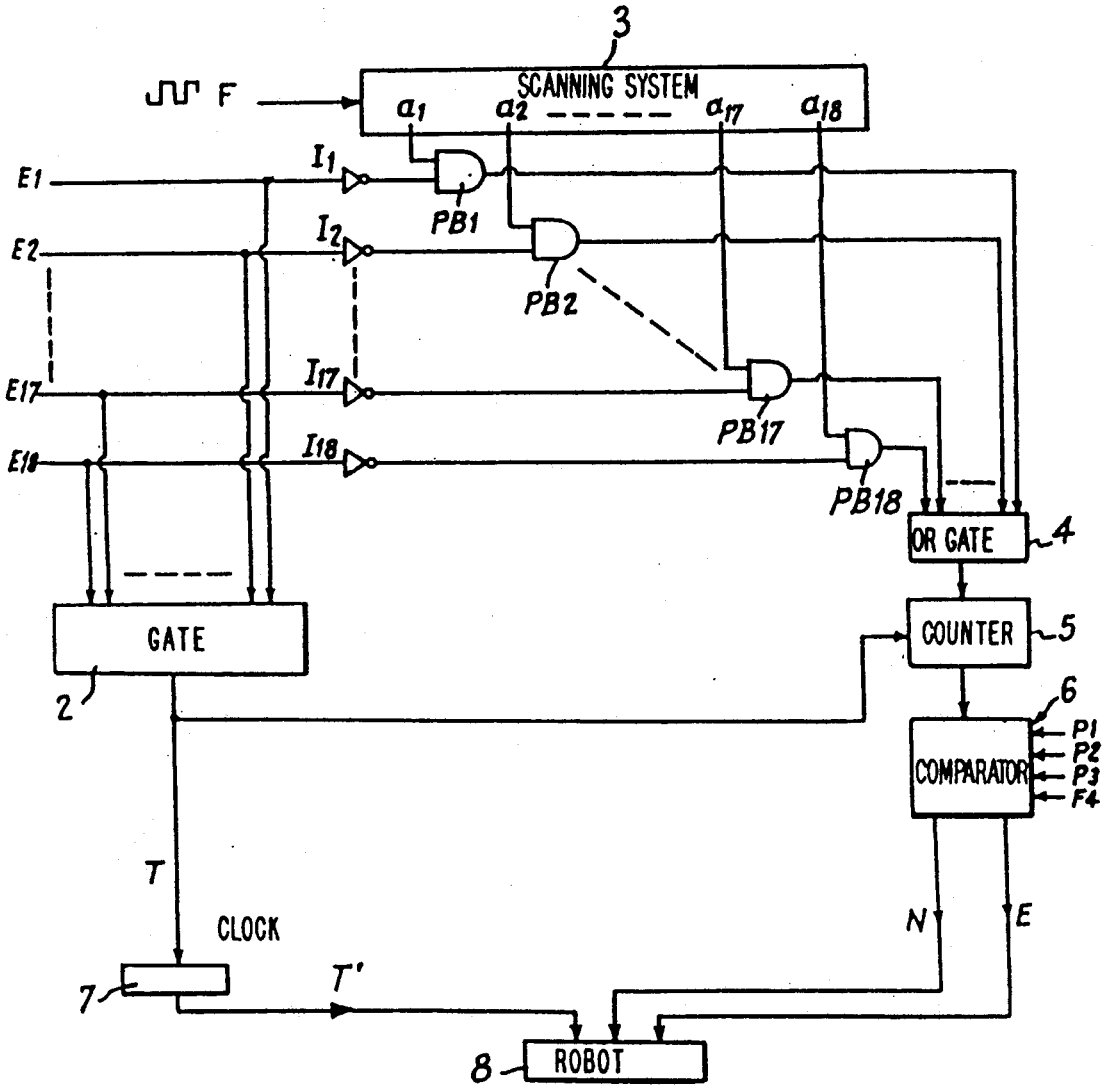

FIG. 2 illustrates the inputs E1-E18. To simplify the figure, certain repetitive elements are not shown and are only referred to by broken lines.

Each input Ei of the card is connected, on the one hand to one of the inputs of a general gate 2 of the "ET" type and, on the other hand, by means of an inverter with signal Ii (I1-I18) to one of the two inputs of an individual gate PBi (PB1-PB18) of the "AND" type.

Each of the other door inputs PBi is connected to one of the outlets of a scanning system 3 and each of the outlets of the gates is connected to one of the inputs of a general gate 4 of the "OR" type having a single output connected to a counter 5, itself connected to a comparator 6.

Figures 3A, 3B, 3C, 3D, 3E, 3F, 3G, 3H, 3I, 3J, 3K:
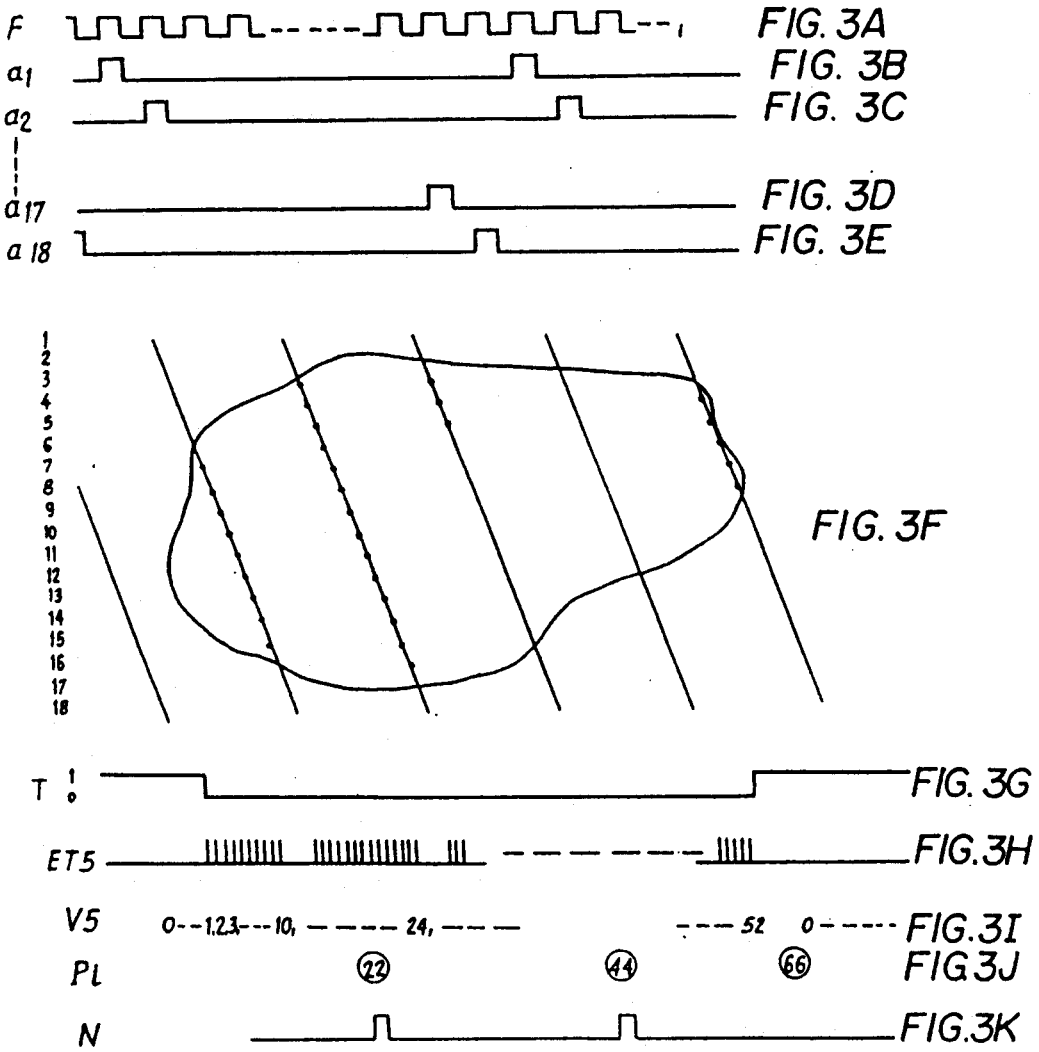
FIG. 3 shows diagrams of the principle of counting by scanning.

The scanning system 3 in the form of an oscillator supplied by a frequency signal F, is adapted to emit periodical signals "ai" (a1-a18), in the form of intervals, regularly offset from one another, in time, as FIG. 3 shows.

The signals "ai" are thus applied as already stated to the second inputs of the corresponding gates PBi, as FIG. 2 shows.

When a luminous beam, between the points of emission and reception respectively of an emitter-receiver is not cut, said emitter-receiver emits a signal of level 1, as is the case for the emitter-receivers ER1–ER4 and thus the inputs E1–E4 and the emitter-receivers ER15–ER18 and thus the inputs E15–E18, whereas on the contrary the signal is at a level of zero for the emitter-receivers ER5–ER14 and the corresponding inputs E5–E14.

After the inverters I1–I18, said signals are obviously reversed such that at the output of the gates PB1–PB18, the signal is at level 1, only if Ei is at zero (cut beam) and the signal "ai" at 1 which corresponds to the moment of the scanning of the corresponding cell formed by the emitter-receiver ERi.

The system 3 thus makes it possible by cyclical scanning to read the signals of each input. Each time an output signal of a door PBi is at level 1, a signal 1 in the form of a deduction impulse is emitted at the output of the OR gate 4 and can be accounted for by the counter 5, which is moreover reset to zero and freed by a signal T coming from the AND gate 2. The signal T commands the counter 5 when said signal is at zero. This level of zero at the output of the door 2 is obtained as soon as a signal Ei is itself at zero, i.e. as soon as a corresponding light beam is interrupted.

Thus, when an object crosses the barrier formed by the light beams, at least one of the beams is interrupted; the signal T falls to zero, frees the counter 5, while the scanning system 3 permits a cyclical reading of the signals of all the emitter-receivers, which are counted in the form of impulses of deduction in said counter 5, as FIG. 3 shows. In FIG. 3, is an example of scanning a1–a18 from a frequency F, a diagram schematically showing the scanning and the shape of the object that one can deduce, the signal T which permits a counting at level zero, a diagram ET5 which shows the impulses gathered at the input of the counter 5 and the values V5 thus determined by the counter 5, which are sent, as specified above in connection with FIG. 2, to a comparator 6. The comparator 6 is adapted to compare different predetermined values (here P1–P4) with respect to the input values of said comparator.

As FIG. 3 further shows, the predetermined values are, for example, multiples of 22. Each time that a predetermined value P1–P4 is reached, a counting impulse N is emitted.

The predetermined values P1–P4 and the scanning frequency F are of course selected with respect to the nature of the objects to be counted, whose conveying velocity is obviously pre-established.

In the example shown in FIG. 3, for example an object corresponds to 22 deduction impulses and it can be thus determined that there were in this example two objects in the group which was conveyed in the apparatus.

The signal T is moreover sent to a comparison clock 7, which is adapted to create an alarm signal T' when the duration during which the signal T is at zero, is greater than a predetermined value, for example 8/10 of a second. In effect, this predetermined value corresponds to the maximum time estimated for the passage of a group of objects. In the case where this value is exceeded, there would be the risk of defects (defective emitter-receiver, stain on an optic fiber, object blocked in the apparatus, etc.).

In this case, the signal T, thus created makes it possible, for example, to activate an alarm and/or to stop the apparatus as well as a programmed robot 8 (FIG. 2), which will be described below.

The comparator 6 of FIG. 2 delivers, as specified above, counting impulses N after comparison with predetermined values Pi. When the number of objects conveyed becomes too great, there can be a risk of counting error and this is why the comparator 6 is preferably provided to also deliver a signal E when the number of impulses N becomes greater than a certain number, 4 for example.

As FIG. 2 shows, the signals T', N and E are sent to a robot 8.

The robot 8 is programmable and manages the three signals cited above with a view, for example, to displaying the number of objects conveyed (by means of the number of counting impulses N), to command the possible stop of the apparatus and/or of a part of the automated line into which the apparatus is integrated (by means of signal T' and/or E), to command an alarm (by means of the signal T' and/or E) and to manage these signals with a view, for example, to commanding a placement in containers of the objects counted, by predetermined quantities, by means of other robotized apparata, ect.

Numerous modifications can be made without going beyond the scope of the invention. For example the clock for comparison 7 could be incorporated into the robot 8, or, as already stated, the horizontal placement of the emission and reception points may be preferred over the vertical placement shown, etc.

We claim:

1. Apparatus for counting objects comprising a light emitting system adapted to form an emission zone, a light receiver system forming several reception points, which are substantially aligned, a passage between the emission zone and the reception points, to permit the conveying of objects to be counted in a manner substantially perpendicular to the alignment of the reception points, and a counting system, which is provided to determine the number of objects conveyed with respect to the variations of the light received at the points of reception, said variations being due to the interposition of the objects between the emission zone and the reception points, said receiver system comprising a plurality of receivers adapted to each form a reception point, while the emitter system comprises as many individual emitters as there are receivers and forms a plurality of emission points, which are substantially aligned, the emitters being provided to each emit a directional light beam and respective receivers being associated as a pair with respective emitters, such that each receiver is provided to gather, in the absence of the object, the light beam of the emitter to which it is associated, each emitter-receiver pair consequently creating a distinct signal.

2. Apparatus according to claim 1, wherein each emitter-receiver pair presents itself in the form of a single unit connected by optic fibers, on the one hand to an emission point and, on the other hand, to a reception point.

3. Apparatus according to claim 1, wherein each emitter is provided to emit a luminous beam of modulated infrared light.

4. Apparatus according to claim 1, comprising a system for transformation of the signals coming from the receivers, to transform them into impulses for counting of objects.

5. Apparatus according to claim 4, wherein the system for transformation of signals comprises a cyclical scanning means which is provided to periodically transform each signal into a deduction impulse when said signal is in a certain state.

6. Apparatus according to claim 5, wherein a counter is provided to count the number of deduction impulses which are emitted at each scanning cycle.

7. Apparatus according to claim 6, wherein a comparator is provided to compare the number of deduction impulses at certain predetermined values and to emit a counting impulse each time the number of deduction impulses reaches one of the predetermined values.

8. Apparatus according to claim 6, wherein each receiver is connected to one of the inputs of a logic gate, said logic gate being connected to the counter of deduction impulses, so as to deliver an output signal, which frees said counter as soon as said signal shows a state for which at least one of the luminous beams is interrupted.

9. Apparatus according to claim 8, wherein said logic gate is likewise connected to a clock for comparison adapted to deliver an alarm signal when the signal of the gate remains in the state corresponding to the interruption of at least one of the beams, during a period of time which becomes greater than a predetermined period of time.

10. Apparatus according to claim 7, wherein the comparator is provided to generate a signal for alarm or error when the number of counting impulses becomes greater than a predetermined value.

11. Apparatus according to claim 1, further comprising a robot adapted to manage the signals furnished by said apparatus to control a placement in containers of the objects counted, by predetermined quantities.

* * * * *